United States Patent [19]

Coley

[11] Patent Number: 4,549,331

[45] Date of Patent: Oct. 29, 1985

[54] BUTTON FOR RECEIVING AND SECURING A FABRIC COVERING THEREFOR AND FABRIC-COVERED BUTTON ASSEMBLY FORMED THEREWITH

[75] Inventor: Charles R. Coley, Blowing Rock, N.C.

[73] Assignee: Plus One Ltd., Blowing Rock, N.C.

[21] Appl. No.: 541,357

[22] Filed: Oct. 12, 1983

[51] Int. Cl.[4] ..... A44B 1/12; A44B 1/38

[52] U.S. Cl. ..... 24/92; 24/90 B; 24/102 T; 24/113 R

[58] Field of Search ..... 24/90 B, 92, 102 T, 24/113 R; 5/472

[56] References Cited

U.S. PATENT DOCUMENTS

| | | | |
|---|---|---|---|
| 2,640,238 | 6/1953 | Schuhr | 24/113 R |
| 2,654,927 | 10/1953 | Tansman | 24/113 R |
| 2,716,794 | 9/1955 | Zelenay | 24/113 R |
| 2,947,049 | 8/1960 | Mishkin | 24/113 R |
| 3,829,935 | 8/1974 | Critchfield | 24/113 R |
| 3,908,236 | 9/1975 | Shepherd | 24/90 B |
| 3,934,314 | 1/1976 | Whysall | 24/113 R |
| 4,012,812 | 3/1977 | Black | 24/113 R |
| 4,123,825 | 11/1978 | Messler et al. | 24/90 B |
| 4,387,488 | 6/1983 | Kanzaka | 24/92 |

FOREIGN PATENT DOCUMENTS

| | | | |
|---|---|---|---|
| 831316 | 3/1960 | United Kingdom | 24/113 R |

*Primary Examiner*—Victor N. Sakran

*Attorney, Agent, or Firm*—Shefte, Pinckney & Sawyer

[57] ABSTRACT

A button for receiving and holding a fabric covering which includes a base element having a hollow cylindrical body with a conical outwardly tapering flange extending from one axial end toward the other and a cap member to be outwardly covered by a fabric piece and having a concave interior surface for receiving the cylindrical body and flange and engaging therebetween the edge of the fabric covering, a central cylindrical wall for insertion in the cylindrical body and an annular lip for disposition outwardly of the flange to retain the base element in the cap member. The axial dimension of the interior area of the cap member is greater than the axial dimension of the cylindrical body and flange of the base element for insertion of the base element to varying depths into the cap member. The diametric dimension of the cap member is slightly smaller than the diametric dimension of the flange of the base element for flexure of the flange upon assembly to engage the fabric edge therebetween. Thus, the button adapts readily to fabric coverings of varying thicknesses by variance of the depth of insertion of the base element in the cap member and variance of the degree of flexure of the flange in relation to the fabric thickness.

14 Claims, 3 Drawing Figures

FIG. 1
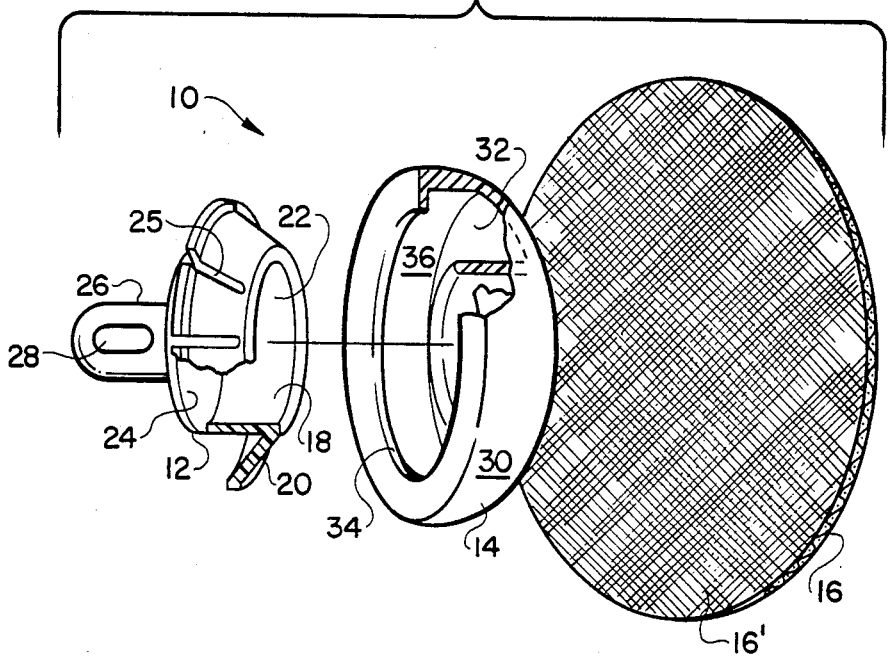
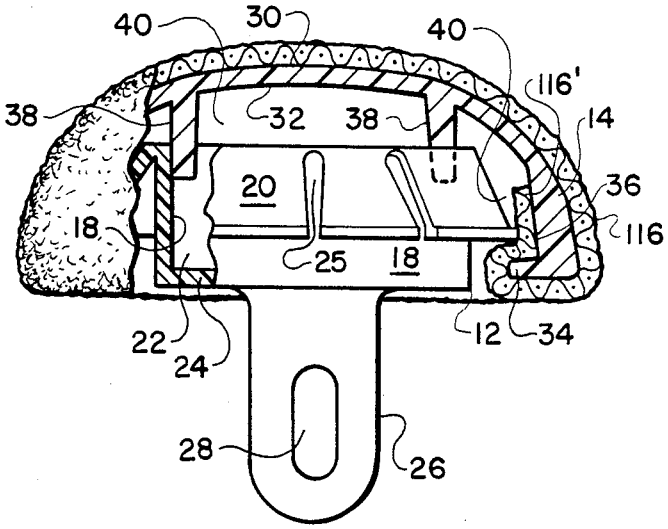
FIG. 2

BUTTON FOR RECEIVING AND SECURING A FABRIC COVERING THEREFOR AND FABRIC-COVERED BUTTON ASSEMBLY FORMED THEREWITH

BACKGROUND OF THE INVENTION

The present invention relates to buttons and particularly to fabric covered button assemblies such as are used in apparel, upholstery and the like.

Buttons generally have many and varied uses in numerous fields and, in certain embodiments such as the tufted upholstery of furniture, the manufacture of certain forms of wearing apparel, e.g., women's dresses, and like uses, it has long been conventional practice to enhance the overall aesthetic appearance of the basic article by covering the buttons being used therein with the same fabric or similar material employed in the basic article. Typically, a particular button construction is employed for this purpose basically using a button cap or shell to be covered by the fabric or material and adapted to be affixed to a collet or other body member clamping the fabric edges to hold the fabric in place about the cap. Examples of this type of button construction are disclosed in U.S. Pat. Nos. 3,829,935; 3,908,236; 4,012,812; and 4,123,825.

While many various forms of this basic type of covered button assembly have been proposed and used in the past, virtually all such button assemblies suffer the common disadvantage that the fabric covered cap is likely when placed under stress to separate from the main body of the button, commonly referred to in the art as "button popping". Once a button cap has become separated, it is difficult if not impossible to securely re-affix it to the main body of the button, thereby leaving the unsightly main body visible in the article and sometimes creating a potential hazard in the continued use of the article if the main body has any sharp edges or is otherwise likely to cut or be snagged on other articles.

Various types of arrangements have been proposed for securing the button cap and the body member together against separation but such arrangements either do not sufficiently prevent separation of the two components or do not facilitate use of the same cap and body member with differing covering fabric thicknesses or suffer both disadvantages. For instance, in one known form of this basic type of covered button assembly, a hollow hub having an interior serration is formed on the inner surface of the button cap and a cone-shaped portion is formed on the body member to be engaged in the hub to lock the cap and body member together. Although this construction is relatively effective for locking the button components together, it is relatively ineffectice for adapting to securely hold fabrics of differing thicknesses.

While it is considered advantageous that a button assembly be capable of use with varying thicknesses of fabric, conventional button assemblies are generally designed with limited tolerances between the button cap and main body to provide a reasonably tight fit for the purpose of securely holding the fabric in place therebetween, and such button assemblies are, therefore, usable in most instances with only a limited range of fabric thicknesses, and different button assemblies and/or closing dies are required for different fabric thicknesses. Moreover, incorrect use of such button assemblies with fabrics of thicknesses other than those for which the button assemblies are intended, which often occurs, creates an even greater likelihood of the incidence of button popping.

There is disclosed in copending U.S. patent application Ser. No. 483,569, filed Apr. 11, 1983, entitled "Button For Receiving And Securing A Fabric Covering Therefor And Fabric-Covered Button Assembly Formed Therewith", a novel and advantageous construction of a compatible button cap and expandable body member adapted in assembly for receipt of the body member to varying depths within the cap member for progressively greater expansion of the body member whereby the cap and body member are capable of ready adaptation for use with varying thicknesses of covering fabric.

The present invention provides another button which is particularly constructed for secure assembly with fabrics of widely varying thicknesses and to conform in assembly to the particular thickness of fabric being used to securely hold the fabric in place.

SUMMARY OF THE INVENTION

Basically, the present button includes a deformable base element and a compatible, relatively inflexible cap member adapted for receiving the base element for engaging a fabric covering therebetween. Briefly described, the base element has a central body portion and a resilient fabric-engaging flange extending outwardly therefrom and annularly thereabout. The cap member has an interior surface portion including an annular wall portion and has an annular lip extending inwardly from the annular wall portion defining an interior area. The interior area is dimensioned between the annular wall portion slightly smaller than the corresponding dimensioning across the flange. Thus, in assembly, the cap member receives the base element in the interior area with the annular wall portion of the cap member in deforming engagement with the flange of the base element for engaging fabric therebetween. The annular lip is disposed outwardly of the flange retaining it in the interior area.

The flange is resiliently deformable to varying degrees for accommodating selective engagement between it and the annular wall portion of fabrics of varying thicknesses. In conjunction with the varying deformability of the flange, the cap member is adapted for receiving the base element to varying depths inwardly within the interior area in inverse relation with the thickness of the fabric engaged between the cap member and base element.

Preferably, the cap member includes a cylindrical wall depending centrally from its interior surface portion into the interior area and the base element includes a cylindrical wall surface on its body portion for mating frictional fitting of one of the cylindrical wall and the cylindrical wall surface within the other upon receipt of the base element in the interior area. In this manner, the base element is frictionally retained within the cap member at any of its varying depths therein.

In the preferred embodiment, the body portion of the base element is cylindrical in shape and the flange is conical in shape and extends from adjacent one axial end of the body portion taperingly outwardly in the direction of the other axial end thereof for flexure toward the body portion upon deformed engagement with the annular wall portion of the cap member. A plurality of slots are preferably provided in the flange extending radially inwardly thereof from its outward edge at circumferential spacings thereabout to facilitate such flexure of the flange. The interior surface portion of the cap member is preferably concave in shape to be compatible with the base element.

BRIEF DESCRIPTION OF THE DRAWINGS

FIG. 1 is an exploded view in perspective of the preferred embodiment of the button assembly of the present invention;

FIG. 2 is a vertical cross sectional view of the button assembly of FIG. 1 in assembled form with a relatively thick covering fabric.

DESCRIPTION OF THE PREFERRED EMBODIMENT

Figure 3:
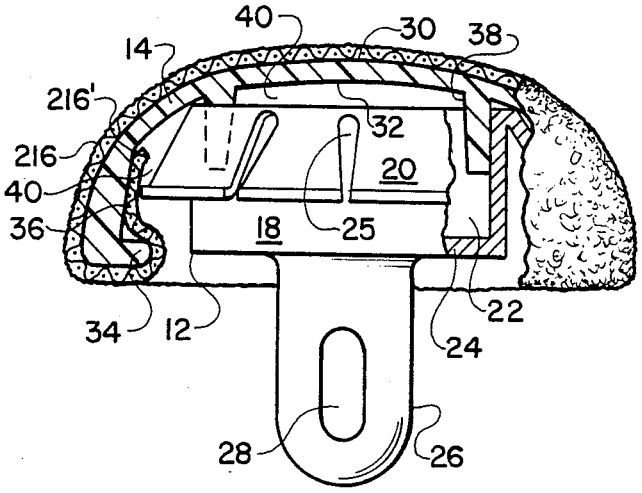
FIG. 3 is a vertical cross sectional view of the button assembly of FIG. 1 in assembled form with a relatively thin covering fabric.

Referring now to the accompanying drawings and initially to FIG. 1, the button assembly of the present invention is shown in non-assembled form generally at 10 and basically includes a base element 12, sometimes referred to in the trade as a collet, a cap member 14 adapted to receive the base element 12, and a fabric piece 16 adapted to cover the exterior surface of the cap member 14 with the fabric's annular edge engaged between the base element 12 and the cap member 14 to hold the fabric piece 16 in place.

The base element 12 is molded of a suitable resilient material, preferably spring metal or a plastic, and includes a cylindrical body portion 18 from one axial end of which a conical flange portion 20 extends taperingly outwardly in the direction of the other axial end of the body portion 18. As will thus be understood, the resiliency of the material from which the base element 12 is constructed permits resilient deforming flexure of the flange portion 20 radially inwardly toward the cylindrical body portion 18. Additionally, the flange portion 20 is provided with plural slots 25 formed at circumferential spacings thereabout to extend radially inwardly therein from its outward annular edge to facilitate inward flexure of the flange portion 20. The cylindrical body portion 18 has a hollow interior area 22 with a radial wall 24 extending across the axial end of the body portion 18 opposite the flange portion 20, whereby the hollow interior 22 of the cylindrical body portion 18 is open at such axial end thereof. A mounting stem 26 having an eyelet 28 formed therethrough depends centrally from the outwardly facing surface of the radial wall 24.

The cap member 14 is molded of a selected material, preferably also a plastic, which is relatively inflexible in comparison with the material of the base element 12. The cap member 14 is formed generally as a rounded shell having a concave exterior surface portion 30 and an interior surface portion 32. An annular lip 34 extends radially inwardly from the outermost portion of the cap member 14. The interior surface 32 includes a slightly conical annular wall portion 36 adjacent the annular lip 34. A cylindrical wall 38 depends centrally from the interior surface 32 substantially coaxially with the cap member 14.

The cap member 14 thusly provides an interior receiving area 40 defined by its interior surface portion 32, its annular lip 34 and its cylindrical wall 38, which are shaped and dimensioned to receive compatibly and to retain the cylindrical body portion 18 and the flange portion 20 of the base element 12 within the receiving area 40. The diametric dimension of the cap member 14 at the radially inwardmost edge of its annular lip 34 is slightly larger than the smallest diametric outer dimension of the flange portion 20 of the base element 12 at the location of its connection with the cylindrical body portion 18 thereof, and is smaller than the largest diametric outer dimension of the flange portion 20 at its outermost free annular edge. Further, the largest diametric dimension of the cap member 14 between its annular interior wall surface portion 32 is slightly greater than the largest diametric dimension of the flange portion 20 of the base element 12. The outer diametric dimension of the cylindrical depending wall 38 of the cap member 14 is substantially identical to the inner diametric dimension of the hollow interior area defined by the cylindrical body portion 18 of the base element 12. The axial dimension of the receiving area 40 of the cap member 14 is slightly greater than the total axial dimension of the cylindrical body portion 18 and the flange portion 20 of the base element 12.

The fabric piece 16 is cut from a selected fabric material in a substantially circular shape of a diameter sufficiently greater than the diametric peripheral dimension of the cap member 14 about its exterior surface portion 30 and along its annular lip 34 thereby to adapt the fabric piece 16 to outwardly cover the cap member 14 with a sufficient excess of the fabric piece 16 at its annular fabric edge portion 16' to be turned about the lip 34 and to extend into the receiving area 40 of the cap member 14.

The assembling of the base element 12, the cap member 14 and the fabric piece 16 will thus be understood. The fabric piece 16 is initially positioned symmetically on the exterior surface portion 30 of the cap member 14 and is conformed thereto and the annular fabric edge portion 16' is wrapped about the annular lip 34 to extend thereabout and into the receiving area 40. The base element 12 is then received by the cap member 14 by insertion first of the axial end of the cylindrical body portion 18 from which the flange portion 20 extends followed by the flange portion 20 into the receiving area 40 of the cap member 14. Since the cap member 14 is relatively inflexible in comparison with the base element 12, the annular lip 34 of the cap member 14 engages the flange portion 20 of the base element 12 and causes flexure thereof inwardly of the cylindrical body portion 18 of the base element as it is inserted into the interior area 40, whereby passage of the base element 12 through the opening defined by the annular lip 34 is permitted. Once the base element 12 has been inserted sufficiently into the interior area 40 of the cap member 14 sufficiently to move the flange portion 20 past the annular lip 34, the resiliency of the material of which the base element 12 is constructed causes the flange portion 20 to be urged elastically to return to its original shape. However, since the annular interior wall portion 36 of the cap member 14 is of a smaller diametric dimension than the flange portion 20, and further since the annular fabric edge 16' is disposed within the interior area 40 adjacent such annular interior wall portion 36, the flange portion 20 is prevented from fully returning to its normal disposition outwardly tapered relative to the cylindrical body portion 18 of the base member 12 and thereby the annular fabric edge portion 16' is firmly engaged and gripped between the outer annular surface of the flange portion 20 of the base element 12 and the annular interior wall portion 36 of the cap member 14.

Also upon receipt of the cylindrical body portion 18 and flange portion 20 of the base element 12 within the interior area 40 of the cap member 14, the cylindrical wall 38 of the cap member 14 extends into the hollow interior 22 of the cylindrical body portion 18 by sliding frictional engagement of the outer surface of the cylindrical wall 38 with the inner cylindrical wall surface of the cylindrical body portion 18. This friction fit between the cylindrical wall 38 and the cylindrical body portion 18 aids in retaining the base member 12 in assembled relation with the cap member 14. The annular lip 34 of the cap member 14 also is disposed outwardly of the flange portion 20 to retain it in the interior area 40, thereby for preventing undesired disassembly of the base element 12 from the cap member 14.

As will be understood, the above-described assembling of the base element 12, the cap member 14 and the fabric piece 16 will ordinarily be performed by a conventional tool or die press. Various forms of such apparatus are known and any of a variety thereof may be used for or adapted to be used for the present button assembly. Such apparatus form no part of the present invention and accordingly are not described herein.

As will also be understood, the above-described compatible arrangement of the base element 12 and the cap member 14 permits them to adapt themselves, when assembled, for secure engagement and holding of fabric pieces having a wide range of varying thicknesses. The annular edge portion of a relatively thick fabric will necessarily occupy a greater amount of space within the receiving area 40 of the cap member 14 than will a relatively thin fabric. Accordingly, the annular edge portion of a relatively thick fabric more greatly reduce the available radial space within the receiving area 40 for occupation by the cylindrical body portion 18 and the flange portion 20 of the base element 12 than will a relatively thin fabric. The resiliency of the plastic material of which the base element 12 is constructed in conjunction with the tapered conical construction of the flange portion 20 of the base element 12 and the dimensioning of the cylindrical body portion 18 and the flange portion 20 of the base element 12 relative to the dimensioning of the interior area 40 of the cap member 14 are effective to permit the insertion of the base element 12 into the interior area 40 of the cap member 14 to varying depths in inverse relation to the thickness of the fabric 16 being employed and to cause varying degrees of radially inward flexure of the flange portion 20 of the base element 12 in direct relation to the depth of insertion of the base element 12 into the receiving area 40 of the cap member 14. Thus, with any given fabric covering 16 employed in the button assembly 10, the degree to which the particular thickness of the fabric edge portion 16' restricts the radial space of the receiving area 40 available for the cylindrical body portion 18 and flange portion 20 of the base element 12 will determine the depth to which the base element 12 is inserted into the interior area 40 and the degree of radially inward flexure of the flange portion 20 necessary to adapt to the fabric thickness while maintaining secure engagement of the fabric edge portion 16' between the outer fabric engaging surface of the flange portion 20 and the interior annular surface portion 36 of the cap member 14. The frictionally fitted insertion of the cylindrical wall 38 of the cap member 14 into the hollow interior area 22 of the cylindrical body portion 18 of the base element 12 will also be understood to occur to varying degrees depending upon the degree to which the base element 12 is inserted into the interior area 40 of the cap member 14. At all inserted depths of the base element 12 into the cap member 14, the frictional engagement between the cylindrical wall 38 of the cap member 14 and the cylindrical body portion 18 of the base element 12 aids in frictionally retaining the base element 12 within the cap member 14 at the particular prevailing depth. As will be understood, the above-described adaptation of the base element 12 and the cap member 14 to the fabric thickness occurs substantially automatically in each instance since, once the available and necessary degree of insertion of the base element 12 into the cap member 14 is reached and the proper and desirable degree of flexure of the flange portion 20 occurs for effective fabric engagement, there will be resistance to any further insertion of the base element 12.

In FIGS. 2 and 3, there is shown the button assembly 10 of FIG. 1 in assembled form with relatively thin fabric coverings, respectively. For purposes of enhancing the illustration of the above-discussed adaptability of the base element 12 and cap member 14 to fabrics of differing thicknesses, the differences in the dispositions of the button assembly components of each Figure have been somewhat exaggerated and therefore such Figures are to be understood to be somewhat schematic in form. As seen in FIG. 2, a relatively thick fabric covering 116 is employed. Because of the correspondingly greater space in the receiving area 40 of the cap member 14 occupied by the annular fabric edge portion 116', the cylindrical body portion 18 and the flange portion 20 of the base element 12 may be inserted into the receiving area 40 to only a limited extent before the flange portion 20 is radially inwardly flexed to a substantial degree accommodating the fabric thickness whereupon the resiliency of the flange portion 20 effectively and sufficiently causes engagement of the fabric edge portion 116' between the flange portion 20 and the interior annular wall surface portion 36 of the cap member 14 and further insertion of the base element 12 is thereby resisted. The cylindrical wall 38 of the cap member 14 is only partially inserted frictionally into the hollow interior area 22 of the cylindrical body portion 18 for retaining the base element 12 at such inserted depths. As seen in FIG. 3, a relatively thin fabric covering 216 is employed. Because of the correspondingly lesser space in the receiving area 40 occupied by the annular fabric edge portion 216', the cylindrical body portion 18 and the flange portion 20 of the base element 12 may be inserted into the receiving area 40 to a substantially complete extent before substantial inward flexure of the flange portion 20 occurs for resiliently exerting effective gripping engagement of the annular fabric edge portion 216' between the flange portion 20 and the annular wall surface portion 36 of the cap member 14 and further insertion of the base element 12 into the cap member 14 is resisted. The cylindrical wall 38 of the cap member 14 is inserted frictionally into the hollow interior area 22 of the cylindrical body portion 18 of the base element 12 to a considerable extent whereby a significant and sufficient frictional engagement therebetween occurs to retain the base element 12 at such substantially completely inserted depth within the cap member 14.

The present button assembly offers distinct advantages over conventional button assemblies. While as hereinbefore noted, conventional button assemblies are substantially incapable of adaptation to differing fabric covering thicknesses without correspondingly changing the fixed relative dimensions of the button assembly components, the unique capability of the base element 12 of the present assembly for insertion into the cap member 14 to varying depths and the capability of the flange portion 20 of the base element 12 for variable radially inward flexure permits the present button assembly to accept and adapt to a wide variety of differing fabric thicknesses and to provide a secure engagement of all such fabrics without any needed variation in the size or any other structural change of any button assembly component. The annular lip 34 of the cap member 12 acts to securely retain the base element 12 and the cap member 14 in assembly. Furthermore, the frictional engagement between the cylindrical wall 38 of the cap member 14 and the cylindrical body portion 18 of the base element 12 provides supplemental retention of the base element 12 and the cap member 14 in assembly with the base element 12 at its appropriate inserted depth in relation to and as determined by the particular thickness of the fabric being employed. Accordingly, the present button assembly is substantially usable with any ordinary fabric thickness and substantially prevents the occurance of "button popping" i.e., the separation under stress of the cap member 14 from the base element 12, and thereby solves two of the principal problems existant in conventional button assemblies.

The present invention has been described in detail above for purposes of illustration only and is not intended to be limited by this description or otherwise to exclude any variation or equivalent arrangement that would be apparent from, or reasonably suggested by the foregoing disclosure to the skill of the art.

I claim:

1. A button for receiving and securely holding in place a fabric covering therefor comprising:

a. a base element having a central body portion and resilient fabric-engaging flange means extending outwardly therefrom and annularly thereabout, and b. a relatively inflexible cap member having an interior surface portion including an annular wall portion and having an annular lip extending inwardly from said annular wall portion defining an interior area dimensioned between said annular wall portion slightly smaller than the corresponding dimensioning across said flange means for receiving said base element in said interior area with said annular wall portion in deforming engagement with said flange means for engaging fabric therebetween and with said annular lip disposed outwardly of said flange means for retaining said flange means in said interior area, said flange means being resiliently deformable to varying degrees for accommodating selective engagement between said flange means and said annular wall portion of said cap member of fabrics of varying thicknesses and said cap member being adapted for receiving said base element to varying depths inwardly within said interior area in inverse relation with the thickness of fabric engaged between said cap member and said base element.

2. A button according to claim 1 and characterized further in that said body portion of said base element includes a leading side adapted to be disposed inwardmost of said interior area of said cap member upon receipt therein, said flange means of said base element being tapered outwardly and oppositely from said leading side for flexure toward said body portion upon deformed engagement with said annular wall portion of said cap member.

3. A button according to claim 2 and characterized further in that said flange means has plural inwardly extending slots formed in the outward edge thereof to facilitate said flexure thereof.

4. A button according to claim 2 and characterized further in that said body portion of said base element is cylindrical in shape with a substantially hollow interior area, said flange means is conical in shape and extends from adjacent one axial end of said body portion taperingly outwardly in the direction of the other axial end thereof.

5. A button according to claim 4 and characterized further in that said flange means includes a plurality of slots extending radially inwardly thereof from the outward edge thereof at circumferential spacings thereabout to facilitate said flexure thereof.

6. A button according to claim 5 and characterized further in that said interior surface portion of said cap member is generally concave in shape to be compatible with said base element.

7. A button according to claim 5 and characterized further in that said cap member includes a depending engaging portion extending from said interior surface portion into said interior area and said base element includes an engaging portion on said body portion, said depending engaging portion and said engaging portion being adapted for mated frictional engagement with one another upon receipt of said base element in said interior area for frictional retention of said base element within said cap member at any of said varying depths therein.

8. A button according to claim 5 and characterized further in that said cap member includes a cylindrical wall depending centrally from said interior surface portion into said interior area and said base element includes a cylindrical wall surface on said body portion for mating friction fitting of one of said cylindrical wall and said cylindrical wall surface within the other upon receipt of said base element in said interior area for frictional retention of said base element within said cap member at any of said varying depths therein.

9. A button for receiving and securely holding in place a fabric covering therefor comprising:

a. a base element having a cylindrical body portion including a cylindrical wall surface, a resilient fabric-engaging conical flange portion extending from adjacent one axial end of said body portion taperingly outwardly in the direction of the other axial end thereof and a plurality of slots in said flange portion extending radially inwardly from its outward edge at circumferential spacings thereabout for flexure of said flange portion toward said body portion, and b. a relatively inflexible cap member having a concave-shaped interior surface portion including an annular wall portion, a cylindrical wall depending centrally from said interior surface portion, and an annular lip extending inwardly from said annular wall portion defining an interior area dimensioned between said annular wall portion slightly smaller than the corresponding dimensioning across said flange portion for receiving said base element in said interior area with its said one axial end disposed inwardmost thereof, with said annular wall portion in flexing engagement with said flange portion for engaging fabric therebetween, with one of said cylindrical wall and said cylindrical wall surface frictionally engaged within the other and with said annular lip disposed outwardly of said flange portion for retaining it in said interior area, said flange portion being resiliently deformable to varying degrees for accommodating selective engagement between said flange portion and said annular wall portion of said cap member of fabrics of varying thickness and said cap member being adapted for receiving said base element to varying depths inwardly within said interior area in inverse relation to the thickness of fabric engaged between said cap member and said base element.

10. A button assembly comprising:

a. a fabric piece, b. a base element having a central body portion and resilient fabric-engaging flange means extending outwardly therefrom and annularly thereabout, and c. a relatively inflexible cap member having said fabric piece outwardly thereabout and having an interior surface portion including an annular wall portion and an annular lip extending inwardly from said annular wall portion defining an interior area receiving said base element, said annular wall portion deformingly engaging said flange means and engaging the edge of said fabric piece therebetween and said annular lip disposed outwardly of said flange means and retaining it in said interior area, said flange means being deformed by said annular wall portion to a degree accommodating the thickness of the edge of said fabric piece and said base element being received in said cap member at a depth inwardly within said interior area inversely related to the thickness of said fabric.

11. A button assembly according to claim 10 and characterized further in the said body portion of said base element includes a leading side disposed inwardmost of said interior area of said cap member, said flange means of said base element being tapered outwardly and oppositely from said leading side and deformingly flexed toward said body portion by said annular wall portion of said cap member.

12. A button assembly according to claim 11 and characterized further in that said flange means has plural inwardly extending slots formed in the outward edge facilitating said flexure thereof.

13. A button assembly according to claim 10 and characterized further in that said body portion of said base element is cylindrical in shape with a substantially hollow interior area, said flange means is conical in shape and extends from adjacent one axial end of body portion taperingly outwardly in the direction of the other axial end thereof, and said flange means includes a plurality of slots extending radially inwardly thereof from the outward edge thereof at circumferential spacings thereabout facilitating said flexure thereof.

14. A button assembly according to claim 14 and characterized further in that said cap member includes a depending engaging portion extending generally centrally from said interior surface portion into said interior area and said base element includes a projecting engaging portion on said body portion, said depending engaging portion and said projecting engaging portion being frictionally engaged with one another to frictionally retain said base element within said cap member as said depth.

* * * * *

UNITED STATES PATENT OFFICE

CERTIFICATE OF CORRECTION

Patent No. 4,549,331 Dated October 29, 1985

Inventor(s) Charles R. Coley

It is certified that error appears in the above-identified patent and that said Letters Patent are hereby corrected as shown below:

Column 10, Line 19, after "end of" insert -- said -- .

Column 10, Line 25, delete "14" and insert therefor -- 10 -- .

Signed and Sealed this

*Fifteenth* Day of *April 1986*

[SEAL]

*Attest:*

DONALD J. QUIGG

*Attesting Officer*

*Commissioner of Patents and Trademarks*